US007654208B2

(12) United States Patent
Patten

(10) Patent No.: US 7,654,208 B2
(45) Date of Patent: Feb. 2, 2010

(54) MULTI-POSITIONABLE WORK SURFACE

(75) Inventor: Jim W. Patten, Los Alamitos, CA (US)

(73) Assignee: Christine Hundertpfund, Los Alamitos, CA (US)

( * ) Notice: Subject to any disclaimer, the term of this patent is extended or adjusted under 35 U.S.C. 154(b) by 668 days.

(21) Appl. No.: 11/061,267

(22) Filed: Feb. 17, 2005

(65) Prior Publication Data

US 2006/0191449 A1 Aug. 31, 2006

(51) Int. Cl.
*A47B 57/00* (2006.01)

(52) U.S. Cl. ..... 108/96; 108/138

(58) Field of Classification Search ..... 248/240, 248/242, 284.1, 291.1; 312/233, 304, 311, 312/351, 267, 266, 325, 319.2, 319.3, 327, 312/328; 108/136, 138, 137, 92, 93, 96, 108/106, 144.11, 145, 102, 9, 6; 211/150
See application file for complete search history.

(56) References Cited

U.S. PATENT DOCUMENTS

| | | | | | |
|---|---|---|---|---|---|
| 467,991 | A * | 2/1892 | Frederick | 108/39 |
| 651,638 | A * | 6/1900 | Norris | 108/145 |
| 970,071 | A * | 9/1910 | Mautner | 108/69 |
| 973,325 | A | 10/1910 | Waring | |
| 1,778,418 | A | 10/1930 | Cooper | |
| 1,824,822 | A * | 9/1931 | Kradolfer | 248/646 |
| 2,161,323 | A * | 6/1939 | Stephenson | 312/266 |
| 2,170,098 | A * | 8/1939 | Stephenson | 108/136 |
| 2,640,599 | A * | 6/1953 | Hess | 108/29 |
| 2,913,122 | A | 11/1959 | Lomas | |
| 2,938,631 | A * | 5/1960 | Brey | 211/90.01 |
| 3,347,184 | A | 10/1967 | Kiraly | |
| 3,406,999 | A * | 10/1968 | Kozicki | 296/156 |
| 3,857,623 | A * | 12/1974 | Schneller | 312/266 |
| 5,375,514 | A * | 12/1994 | Dann, Jr. | 100/145 |
| 5,490,466 | A * | 2/1996 | Diffrient | 108/96 |
| 5,549,052 | A | 8/1996 | Hoffman | |
| 6,340,214 | B1 * | 1/2002 | Adams | 312/246 |
| 6,672,430 | B2 * | 1/2004 | Boucher et al. | 187/269 |
| 2004/0163327 | A1 * | 8/2004 | Cash | 52/27 |

* cited by examiner

*Primary Examiner*—Janet M Wilkens
(74) *Attorney, Agent, or Firm*—Sheldon Mak Rose & Anderson PC; Jeffrey G. Sheldon

(57) ABSTRACT

An adjustable work surface comprises first and second decks that are pivotally connected by pivot arms. The pivot arms are located and configured so that the second deck can pivot relative to the first deck between a storage position and an extended position where the two decks are in substantially the same plane. The pivot arms are located and configured so that the upper surfaces of both decks are substantially parallel both in the storage position and the extended position. Preferably the forward wall of the first deck and the rear wall of the second deck are configured so the first deck supports the second deck in the extended position.

18 Claims, 3 Drawing Sheets

MULTI-POSITIONABLE WORK SURFACE

BACKGROUND

A common problem, particularly for scrapbookers, is what to do with a project when midway through it. Leaving it out on a work surface can be unsightly and lead to clutter, and possibly lost components of the project. However, to store away the project can be time consuming and can also lead to misplaced or lost components of the project.

Another challenge for persons working on projects such as a scrapbooking is a need for a large work surface. A typical scrapbooker not only has the scrapbook they are working on, but a myriad of pictures, stickers, adhesives, scissors, and the like scattered about. It is not uncommon for a group of scrapbookers to get together, which adds to the clutter. Not many people have available work surfaces large enough to accommodate such large projects.

Many attempts have been made to provide work surfaces with special features. Reference is made to U.S. Pat. Nos. 973,325; 1,778,418; 2,170,098; 2,913,122; 3,347,184; 5,375,514; 5,490,466; and 5,549,052.

Regrettably, none of these work surfaces is adjustable to take up a small space when not being actively used, provides a strong and firm work surface, and allows projects to be safely maintained without having to put them away. Such a work surface is needed.

SUMMARY

The present invention is directed to an adjustable work surface for persons who need a large, stable, easily stored work surface where projects can be stored away without having to remove them from the work surface. The work surface of the present invention comprises first and second decks, each deck having an upper surface, a lower surface, a forward wall, a rear wall and first and second side portions. A first pair of pivot arms pivotally connects the first side portion of the first deck to the first side portion of the second deck, and a second pair of pivot arms pivotally connects the second side portion of the first deck to the second side portion of the second deck. The pivot arms are located and configured so that the second deck can pivot relative to the first deck between a storage position and an extended position. In the storage position, the second deck is at least partially above and spaced apart from the first deck. In the extended position, the upper surface of the second deck is in substantially the same plane as the upper surface of the first deck with a forward wall of the first deck proximate to the rear wall of the second deck.

Preferably, but optionally, the forward wall of the first deck and the rear wall of the second deck are configured so that the first deck supports the second deck. The second deck can be cantilevered from the first deck and supported thereby. For example, the forward wall of the first deck can slope forwardly from its upper surface to its lower surface, and the rear wall of the second deck can be configured to mate with the forward wall of the first deck. Thus, the second deck is strongly maintained in position and can be pushed downwardly without any significant bending or deflection.

The forward wall of the first deck can have a notch or ledge to support the second deck.

Due to the positioning and size of the pivot arms, the upper surface of the two decks are substantially parallel in the storage position and in the extended position, and preferably in all positions as the second deck pivots between the storage and extended position. Typically, the decks are mounted so that the upper surface of both decks are always substantially horizontal. Thus, due to the constant horizontal position, as well as the spacing between the first and second decks in the storage position, it is possible to store the work surface away without having to remove a project from the two decks during storage.

Alternatively, a pair of brackets can be attached to the side portions of the first deck, and the pivot arms attach to the bracket. A pair of gas assists can be attached to the inside of the brackets to assist in cantilevering the second deck between storage and extended positions.

Optionally, the forward wall of the second deck has a handle to allow the user to easily pivot the second deck to and from the extended and storage positions.

The work surface can be mounted substantially or entirely in a housing, such as a cabinet. The work surface can also be mounted in a variety of vessels with limited space, such as a boat.

To use the work surface, a user works on a project while the work surface is in the extended position. Upon temporarily finishing the project, the user pivots the second deck above the first deck into the storage position. The decks remain parallel, and thus, the materials on the work surface remain undisturbed. When the user wishes to return to working on the project, the user pivots the second deck in the extended position.

Thus, a strong, stable, easily stored, and firm work surface is provided which allows a user to conceal a project while not working on the project without having to disturb the materials of the project.

DRAWINGS

These and other features, aspects, and advantages of the present invention will become better understood with reference to the following description, appended claims, and accompanying drawings where:

FIG. 7 is a front elevation view detailing the fastening system used on the pivot arms of the work surface of FIG. 1 mounted on a bearing surface such as a table or the like.

DESCRIPTION

Figure 1:
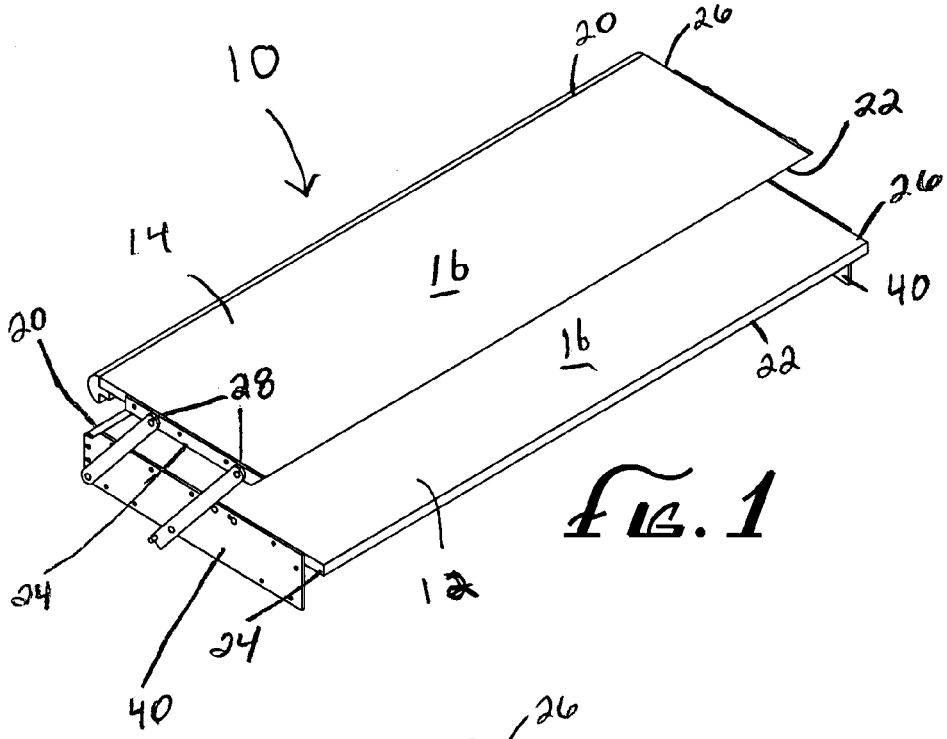
FIG. 1 is a perspective view of an adjustable work surface having features of the present invention in a storage position.

With reference to FIGS. 1-4, an adjustable work surface 10 having features of the present invention comprises a first deck 12 and a second deck 14. Each deck has an upper surface 16, a lower surface 18, a forward wall 20, a rear wall 22, a first side portion 24 and an opposed second side portion 26. The work surface 10 also comprises a first pair of pivot arms 28 pivotally connecting the first side portion 24 of the first deck 12 to the first side portion 24 of the second deck 14. A second pair of pivot arms 30 pivotally connect the second side portion 26 of the first deck 12 to the second side portion 26 of the second deck 14.

Figure 2:
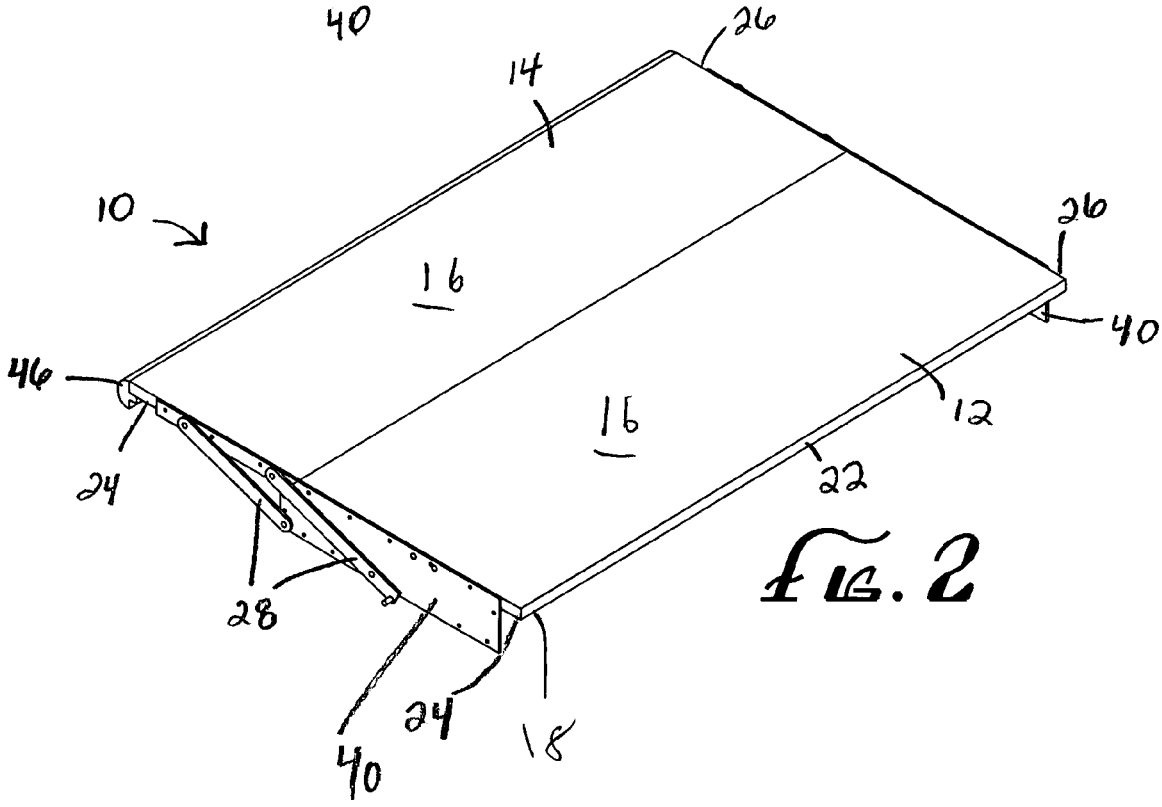
FIG. 2 is a perspective view of the work surface of FIG. 1 in its extended position.

As shown by FIGS. 1 and 2 respectively, the work surface 10 has two positions, a storage position and an extended position. In the storage position, the second deck 14 is spaced apart from the first deck 12 and is at least partially, and preferably totally above the first deck 12. The direction of pivoting from the storage configuration to the expanded configuration is shown by arrow 42 in FIG. 3.

Figure 3:
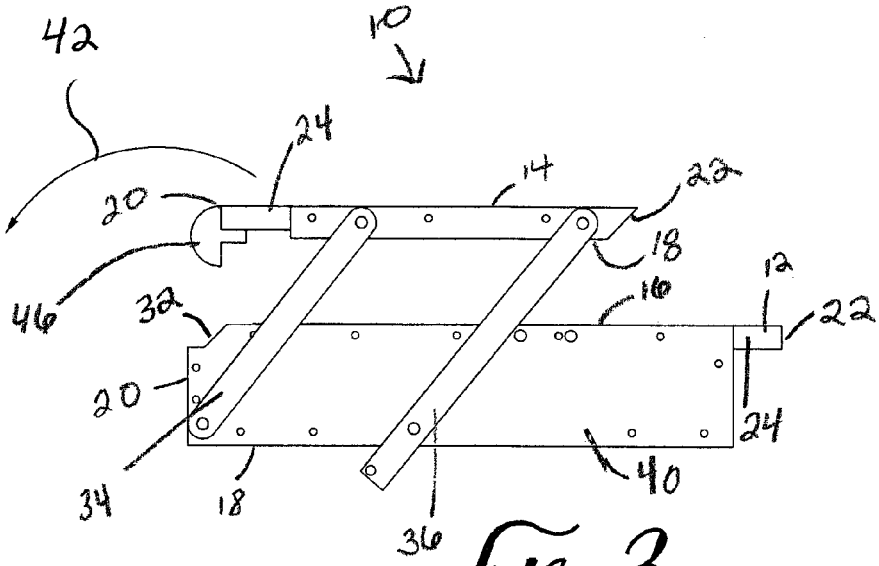
FIG. 3 is a side elevation view of the work surface of FIG. 1 in its storage position.
Figure 4:
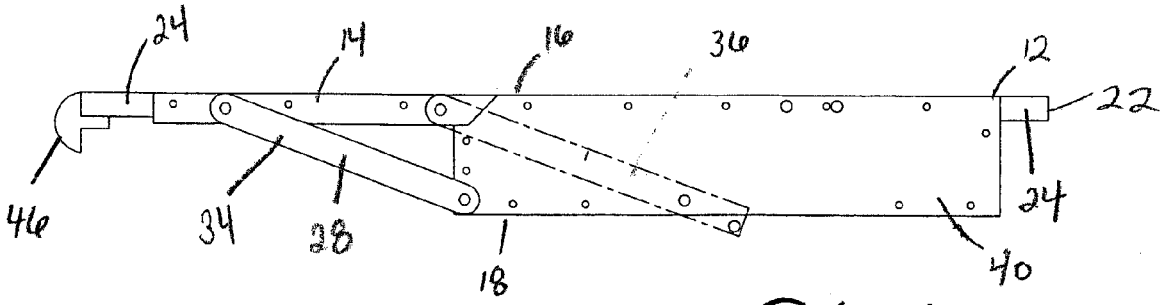
FIG. 4 shows a side elevation view of the work surface of FIG. 1 in its extended position.

In the extended position, the upper surface 16 of the second deck 14 is substantially coplanar with the upper surface 16 of the first deck 12, i.e., the upper surfaces 16 of both decks 12, 14 are substantially coplanar to provide a smooth, large work surface. In the extended position, the forward wall 20 of the first deck 12 is proximate to, and preferably contiguous to the rear wall 22 of the second deck 14. Preferably, the contiguous surfaces are configured so that the forward wall 20 of the first deck 12 supports the second deck 14. This can be accomplished, as shown in FIGS. 3 and 4 by having at least a portion of the forward wall 20 of the first deck 12 slope forwardly from its upper surface 16 to its lower surface 18, with the rear wall 22 of the second deck 14 having the mirror image configuration, i.e., it slopes at substantially the same angle rearwardly from its lower surface 18 toward its upper surface 16. The angle of slope can be in the range of about 25 to about 50 degrees, depending on the lengths of the decks 12, 14.

Figure 7:
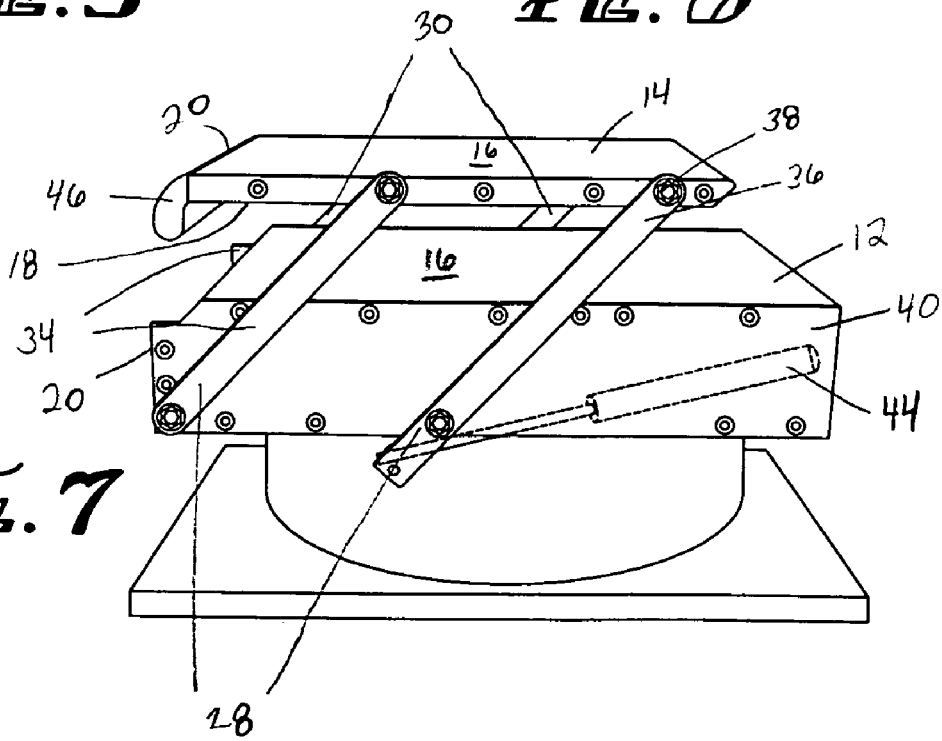

In a preferred version, as shown in FIGS. 3 and 7, the forward wall 20 of the first deck 12 can provide a ledge or a support notch 32 for supporting the second deck 14. An upper portion of the forward wall 20 of the first deck 12 is recessed to receive the rear wall 22 of the second deck 14. The recess has a horizontally extending surface support. The rear wall 22 of the second deck 14 is configured to slope at substantially the same angle rearwardly from its lower surface 18 toward its upper surface 16 in order to fit securely within the notch 32.

The pivot arms 28, 30 are shown in the drawings as being connected to side portions 24, 26. Each pair of pivot arms 28, 30 have a forward arm 34 and a rear arm 36. FIG. 7 shows a preferred fastening mechanism to allow pivoting. This can comprise a partially threaded fastener 38 which extends through a hole (not shown) in the pivot arm 28, 30 and into the side portion 24, 26 of the deck 12, 14. The head portion of the fastener 38 is not threaded to allow smooth pivoting. In a preferred version, the fasteners are screws. The fasteners 38 can alternatively be bearings, bolts, spring pins, or any other convenient mechanism.

Preferably, a pair of brackets 40 attach to the side portions 24, 26 of the first deck 12, and the lower end of the pivot arms 28, 30 connect to the lower portion of the bracket 40 instead of to the side portions 24, 26 of the first deck 12. A pair of gas assists 44 optionally can be used to assist in pivoting the second deck 14 between the storage and extended positions. As shown in FIG. 7, the gas assist 44 is attached at one end to the inside of the bracket 40 with a ball joint (not shown), and at the other end, the gas assist 44 is attached to the lower end of the rear pivot arm 36.

Optionally, a handle 46 is attached to the forward wall 20 of the second deck 14 to enable a user to more easily move the second deck 14.

In an exemplary version of the invention, the work surface 10 is 47 inches wide, 34 inches in length and 4 inches high when in the extended position, and 47 inches wide, 21 inches in length, and 7½ inches high when in the storage position. The length of the first deck 12 and second deck 14 are 19 and 15 inches respectively. The width and length of the work surface can change by increasing or decreasing the size of the decks. The fasteners 38 attach the forward arm 34 of the first and second pairs of pivot arms 28, 30 to the first and second side portions 24, 26 of the first deck 12 at ½ inch from the forward wall 20 of the first deck 12. The fasteners 38 attach the forward arm 34 of the first and second pairs of pivot arms 28, 30 to the first and second side portions 24, 26 of the second deck 14 at 9½ inches from the forward wall 20 of the second deck 12. The fasteners 38 attach the rear arm 36 of the first and second pairs of pivot arms 28, 30 to the first and second side portions 24, 26 of the first deck 12 at 8 inches from the forward wall 20 of the first deck 12. The fasteners 38 attach the rear arm 36 of the first and second pairs of pivot arms 28, 30 to the first and second side portions 24, 26 of the second deck 14 at 17 inches from the forward wall 20 of the second deck 12.

The decks 12, 14 can be made out of any material conventionally used for desks. They can be made out of wood, particle board, metal, plastic, alloys, fiberglass or any other conventional materials to withstand repeated use. Preferably, the decks are made out of medium density fibreboard (MDF) with Formica® laminate of melamine and phenolic plastics laminated on the upper surface and a moisture membrane laminated on the lower surface. This double lamination provides consistent moisture protection on both sides so the decks will not twist or warp from moisture and humidity.

The pivot arms 28, 30 and bracket 40 can be made out of steel, aluminum, structural plastic or the like. The handle 46 can be made of the same or different material as used for the deck.

Figure 5:
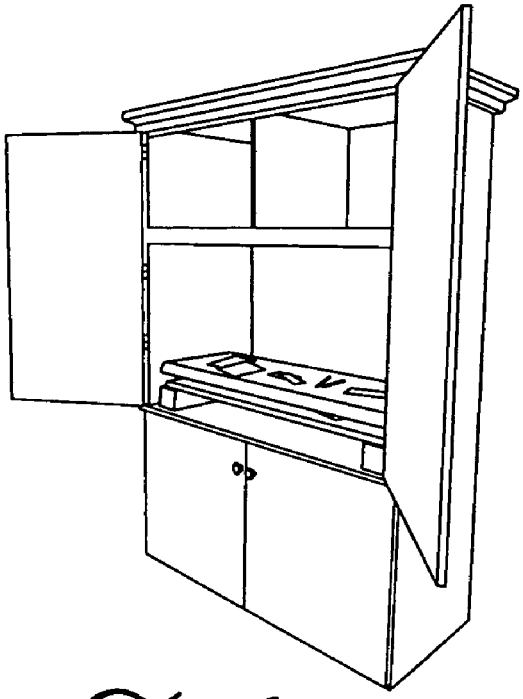
FIG. 5 is a perspective view of the adjustable work surface of FIG. 1 mounted in a support surface such as a cabinet in the storage position.
Figure 6:
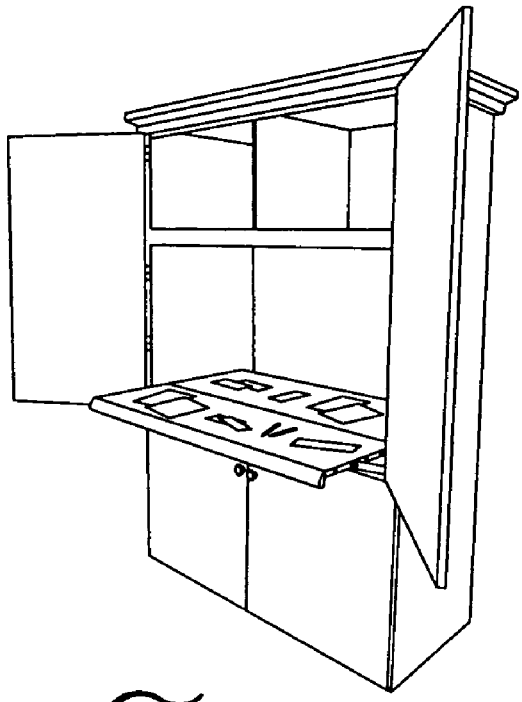
FIG. 6 is view like that of FIG. 5 where the work surface is in its extended position.

The work surface 10 has many applications where it can be used. It can be a portable, self-supporting structure attached to a bearing surface, such as a boat deck, as shown in FIG. 7. Alternatively, as shown in FIGS. 5 and 6, it can be mounted in a cabinet so work projects are out of sight when stored. It also can be used where space is tight, and large surfaces are needed, such as boats, where there are large navigation charts and limited room. It also can be used in recreational vehicles or airplanes where again there is limited space. It can also be used in manufactured housing and mobile homes.

In use, a user uses the work surface 10 in its extended position. When it is time to stop working, the user pivots the second deck 14 into the storage position above the first deck 12, without having to remove any work materials. If the work surface 10 is in a cabinet, the user closes the cabinet doors to conceal the work surface 10. When it is time to work on a project again, the user simply pulls on the handle 46 attached to the second deck 14 until the second deck is back to its extended position to continue working. Because the work station can remain substantially parallel to the ground, everything in the project is exactly where it was left.

Although the present invention has been described in considerable detail with reference to certain preferred versions thereof, other versions are possible. Therefore, the spirit and scope of the appended claims should not be limited to the description of the preferred versions contained herein.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function, should not be interpreted as a "means" for "step" clause as specified in 35 U.S.C. § 112.

What is claimed is:

1. An adjustable work surface comprising:

a) first and second decks, each deck having an upper surface, a lower surface, a forward wall, a rear wall, and first and second side portions;

b) a first bracket attached to the first side portion of the first deck and a second bracket attached to the second side portion of the first deck; and c) a first pair of pivot arms pivotally connecting the first bracket to the first side portion of the second deck, and a second pair of pivot arms pivotally connecting the second bracket to the second side portion of the second deck, wherein the pivot arms are located and configured so that the second deck can pivot relative to the first deck between (i) a storage position with the second deck being at least partially above and spaced apart from the first deck, and (ii) an extended position with the second deck cantilevered with the upper surface of the second deck being in substantially the same horizontal plane as the upper surface of the first deck with the forward wall of the first deck proximate to the rear wall of the second deck, and wherein the upper surfaces of the two decks are substantially parallel in the storage position and in the extended position, and wherein the forward wall of the first deck and the rear wall of the second deck are adjacent and configured so that the first deck supports the second deck in the extended position.

2. The work surface of claim 1 wherein the upper surfaces of the two decks are substantially parallel in all positions as the second deck pivots between the storage position and the extended position.

3. The work surface of claim 1 wherein the forward wall of the first deck slopes forwardly from its upper surface to its lower surface, and the rear wall of the second deck is configured to mate with the forward wall of the first deck.

4. The work surface of claim 1 wherein the forward wall of the first deck comprises a notch for supporting the second deck in the extended position.

5. The work surface of claim 1 wherein an upper portion of the forward wall of the first deck is recessed for receiving the rear wall of the second deck wherein the recess comprises a horizontally extending surface support.

6. The work surface of claim 1 wherein the forward wall of the second deck has a handle.

7. The work surface of claim 1 mounted in a housing, wherein the work surface is contained substantially totally within the housing in its storage position, and wherein the second deck extends at least partially out of housing in the extended position.

8. A desk having the work surface of claim 1 mounted thereon.

9. A boat having the work surface of claim 1 mounted therein.

10. The work surface of claim 1 including at least one gas assist for assisting pivoting of the second deck between the storage position and the extended position.

11. A method for working on a project comprising the steps of:

a) selecting the adjustable work surface of claim 1;

b) working on the project with the work surface in its extended position, the project involving use of materials placed on the upper surface of both the first and the second decks; and c) pivoting the second deck to the storage position while leaving at least some work materials on both the first and second decks.

12. An adjustable work surface comprising:

a) first and second decks, each deck having an upper surface, a lower surface, a forward wall, a rear wall, and first and second side portions;

b) a first pair of pivot arms pivotally connecting the first side portion of the first deck to the first side portion of the second deck, and a second pair of pivot arms pivotally connecting the second side portion of the first deck to the second side portion of the second deck, wherein the pivot arms are located and configured so that the second deck can pivot relative to the first deck between (i) a storage position with the second deck being at least partially above and spaced apart from the first deck, and (ii) an extended position with the upper surface of the second deck being cantilevered and in substantially the same horizontal plane as the upper surface of the first deck with the forward wall of the first deck contacting the rear wall of the second deck, and wherein the forward wall of the first deck and the rear wall of the second deck are configured that the forward wall of the first deck supports the rear wall of the second deck in the extended position, and wherein the forward wall of the first deck and the rear wall of the second deck are adjacent and configured so that the first deck supports the second deck in the extended position.

13. The work surface of claim 12 wherein the upper surfaces of the two decks are substantially parallel in all positions as a second deck pivots between the storage position and the extended position.

14. The work surface of claim 12 wherein the forward wall of the first deck slopes forwardly from its upper surface to its lower surface, and the rear wall of the second deck is configured to mate with the forward wall of the first deck.

15. The work surface of claim 12 wherein the forward wall of the first deck comprises a notch for supporting the second deck in the extended position.

16. The work surface of claim 12 wherein the forward wall of the second deck has a handle.

17. A desk having the work surface of claim 12 mounted thereon.

18. The work surface of claim 12 including at least one gas assist for assisting pivoting of the second deck between the storage position and the extended position.

* * * * *